US007134564B2

(12) United States Patent
Verbovszky

(10) Patent No.: US 7,134,564 B2
(45) Date of Patent: Nov. 14, 2006

(54) BEVERAGE BOTTLE CAP FOR CHILD USE

(76) Inventor: Esther A. L. Verbovszky, 325 N. Falmouth Dr., Rocky River, OH (US) 44116

( * ) Notice: Subject to any disclaimer, the term of this patent is extended or adjusted under 35 U.S.C. 154(b) by 0 days.

(21) Appl. No.: 10/686,846

(22) Filed: Oct. 16, 2003

(65) Prior Publication Data

US 2005/0082301 A1 Apr. 21, 2005

(51) Int. Cl.
*A61J 9/00* (2006.01)
*A47G 19/22* (2006.01)

(52) U.S. Cl. ..... 215/11.4; 215/11.1; 215/305; 220/714; 220/717; D24/196; D24/197

(58) Field of Classification Search ..... 220/705, 220/717, 710.5; 215/11.1, 11.5, 305, 11.4; D24/196, 197
See application file for complete search history.

(56) References Cited

U.S. PATENT DOCUMENTS

| | | | | | |
|---|---|---|---|---|---|
| 1,541,330 | A | * | 6/1925 | Decker | 215/11.1 |
| 2,070,377 | A | * | 2/1937 | Simmons | 215/260 |
| 2,174,361 | A | * | 9/1939 | Condon | 215/11.5 |
| 2,269,223 | A | * | 1/1942 | Porthouse et al. | 215/11.1 |
| 2,388,915 | A | * | 11/1945 | Herman | 215/11.1 |
| 2,443,560 | A | * | 6/1948 | Goodson | 215/11.5 |
| 2,580,069 | A | * | 12/1951 | Blount | 379/31 |
| 2,693,187 | A | * | 11/1954 | Perreault | 215/11.5 |
| 2,709,434 | A | * | 5/1955 | Pancoast | 215/11.5 |
| 2,805,663 | A | * | 9/1957 | Robinson et al. | 215/11.1 |
| 2,816,548 | A | * | 12/1957 | Tupper | 215/11.1 |
| 3,394,018 | A | * | 7/1968 | Velonis et al. | 426/117 |
| 4,428,498 | A | * | 1/1984 | Obey | 220/367.1 |
| 4,676,386 | A | | 6/1987 | Phlaphongphanich | 251/11 R |
| 5,190,174 | A | * | 3/1993 | Klag | 215/11.1 |
| D384,748 | S | * | 10/1997 | Dunn | D24/196 |
| 5,938,053 | A | | 8/1999 | Verbovszky et al. | 251/6 |
| 6,003,698 | A | | 12/1999 | Morano | 215/11.1 |
| 6,032,810 | A | | 3/2000 | Meyers et al. | 215/11.1 |
| 6,494,056 | B1 | | 12/2002 | Roth et al. | 62/457.3 |

* cited by examiner

*Primary Examiner*—Nathan J. Newhouse
*Assistant Examiner*—James Smalley
(74) *Attorney, Agent, or Firm*—Tarolli, Sundheim, Covell & Tummino LLP

(57) ABSTRACT

A cap (12) for a beverage bottle (14) includes a passage (22) through which beverage in the bottle may flow from the bottle. A first portion (24) surrounds the passage (22) and is engageable with the lips of a child adapted to consume the beverage that flows through the passage. A second portion (34) clamping engages the beverage bottle (14) to hold the cap (12) on the bottle. The cap (12) is made of an elastic material and the second portion (34) stretches to clamping engage the bottle (14). At least one manually engageable pull tab (40, 42) is for pulling the second portion (34) onto the bottle (14) while the second portion stretches.

1 Claim, 3 Drawing Sheets

BEVERAGE BOTTLE CAP FOR CHILD USE

TECHNICAL FIELD

The present invention is directed to a beverage bottle cap for child use.

BACKGROUND OF THE INVENTION

Infants typically consume beverages from either baby bottles. Baby bottles are well known products and include a wide mouth bottle container and a nipple covering the mouth of the bottle which delivers a beverage to an infant nursing from the bottle. The nipple is secured to the mouth of the bottle by a baby bottle collar which is a rigid plastic piece that is threaded onto a mating threaded portion of the mouth of the bottle.

Small children, such as toddlers, typically use sipper cups when learning to drink beverages from normal cups. Sipper cups are also well known products and include a cup and a removable lid. The lid has a mouth portion with an opening for delivering a beverage to an infant nursing from the sipper cup. The lid is removed to fill the cup with a beverage. The cup and lid are made of rigid plastic material and are secured together by a snap fit.

The size of the lid of the sipper cup is specific to the size of the cup. The lid is therefore not interchangeable for use with other different sized cups. The nipple and collar of the baby bottle is specifically threaded for use with the bottle portion and is not interchangeable with other bottles.

It is known to adapt commercially available conventional beverage bottles, such as a spring water bottle shown in FIG. 1, for infant use by threading a bottle adapter onto the mouth of the beverage bottle.

FIG. 1 schematically illustrates a conventional beverage bottle 14 with the cap portion removed. The beverage bottle 14 may be for example, a spring water bottle. The beverage bottle 14 includes a container 16 and a threaded mouth 18 with a lip. While the exact shape of the container portion 16 may differ according to brand name, the size of the mouth 18 is typically standard.

SUMMARY OF THE INVENTION

A cap for a beverage bottle includes a passage through which beverage in the bottle may flow from the bottle. A first portion surrounds the passage and is engageable with the lips of a child adapted to consume the beverage that flows through the passage. A second portion clamping engages the beverage bottle to hold the cap on the bottle. The cap is made of an elastic material and the second portion stretches to clamping engage the beverage bottle. A manually engageable pull tab is for pulling the second portion onto the bottle while the second portion stretches.

BRIEF DESCRIPTION OF THE DRAWINGS

The foregoing and other features of the present invention will become apparent to those skilled in the art to which the present invention relates upon reading the following description with reference to the accompanying drawings, in which.

DETAILED DESCRIPTION OF THE INVENTION

Figure 2:
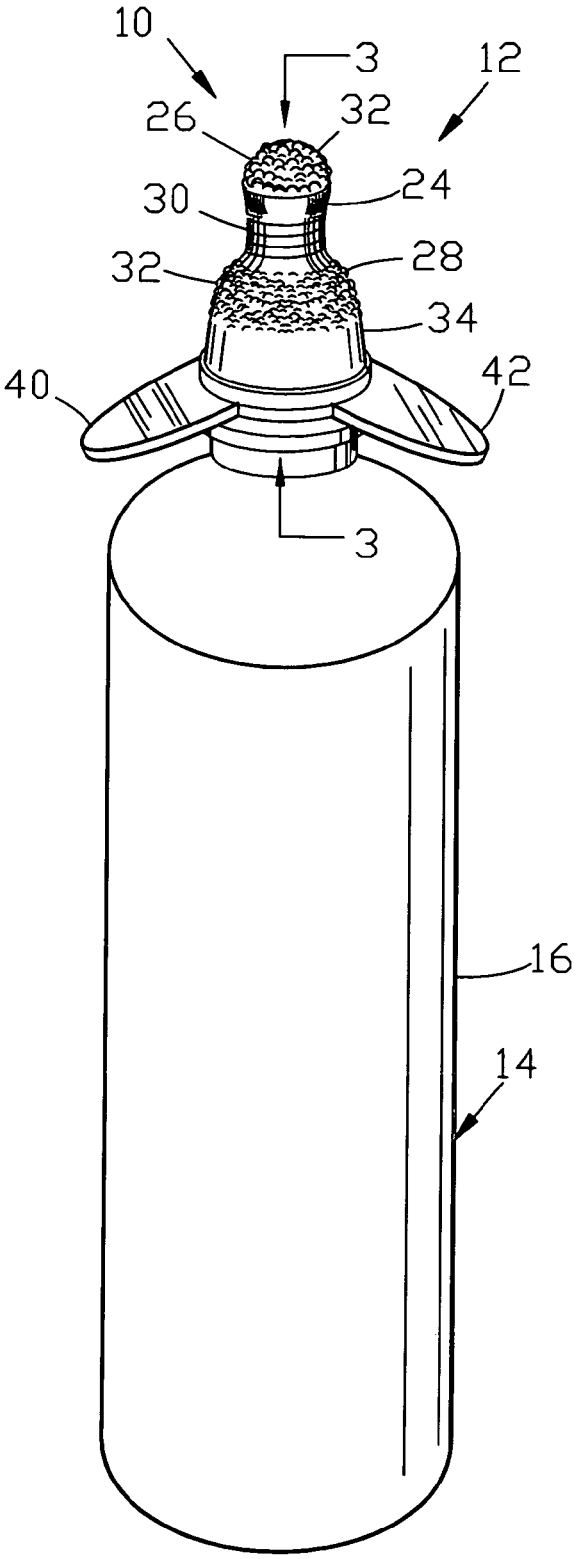
FIG. 2 is a schematic perspective view of the beverage bottle illustrated in FIG. 1 with a cap constructed in accordance with a first embodiment of the present invention.

As representative of the present invention, FIG. 2 illustrates an assembly 10 including a cap 12 secured to the beverage bottle 14. The cap includes an axially extending passage through which beverage in the bottle may flow from the bottle. The entire cap 12 is a pre-formed, one-piece unitary structure made entirely of a soft elastic material such as rubber, latex or silicone. No portion of the cap 12 is rigid or hard. The cap 12 is washable and is repeatedly reusable.

A first portion 24 of the cap 12 surrounds the passage 22 and is engageable with the lips of an infant who consumes the beverage that flows through the passage from the bottle 14. The first portion 24 of the cap 12 is a nipple-like structure.

The first portion 24 has a bulbous terminal end 26 with a small opening in the tip (not shown) and a frustum portion 28 adjacent the terminal end. A plurality of ribs 30 are located intermediate the terminal end 26 and the frustum portion 28. The ribs 30 define a region of smaller diameter than the terminal end 26 and the frustum portion 28 which helps to isolate the terminal end relative to the frustum portion. The ribs 30 provide an area for the infant's lips to engage to help the first portion 24 of the cap 12 conform to the shape of the infant's mouth.

The outer surface 32 of the first portion 24, on the terminal end 26 and the frustum portion 28, has a raspberry effect. The raspberry effect is a rough surface texture with bumps having a rounded end. The raspberry effect simulates the surface texture of a human nipple. Alternatively, in another embodiment (not shown) the outer surface 32 of the first portion 24 can be smooth.

The cap 12 includes a stretchable second portion 34 which clamping engages the beverage bottle 14 to hold the cap 12 on the bottle 14. The second portion 34 is circular in cross section and includes a stop shelf 36 on an inner surface 38 of the second portion 34 at a location immediately adjacent the frustum portion 28. The stop shelf 36 is a protrusion extending around the entire circumference of the second portion 34 in a direction perpendicularly away from the inner surface 38 of the second portion 34. At the location of the stop shelf 36, the diameter of the second portion 34 is abruptly reduced.

Figure 1:
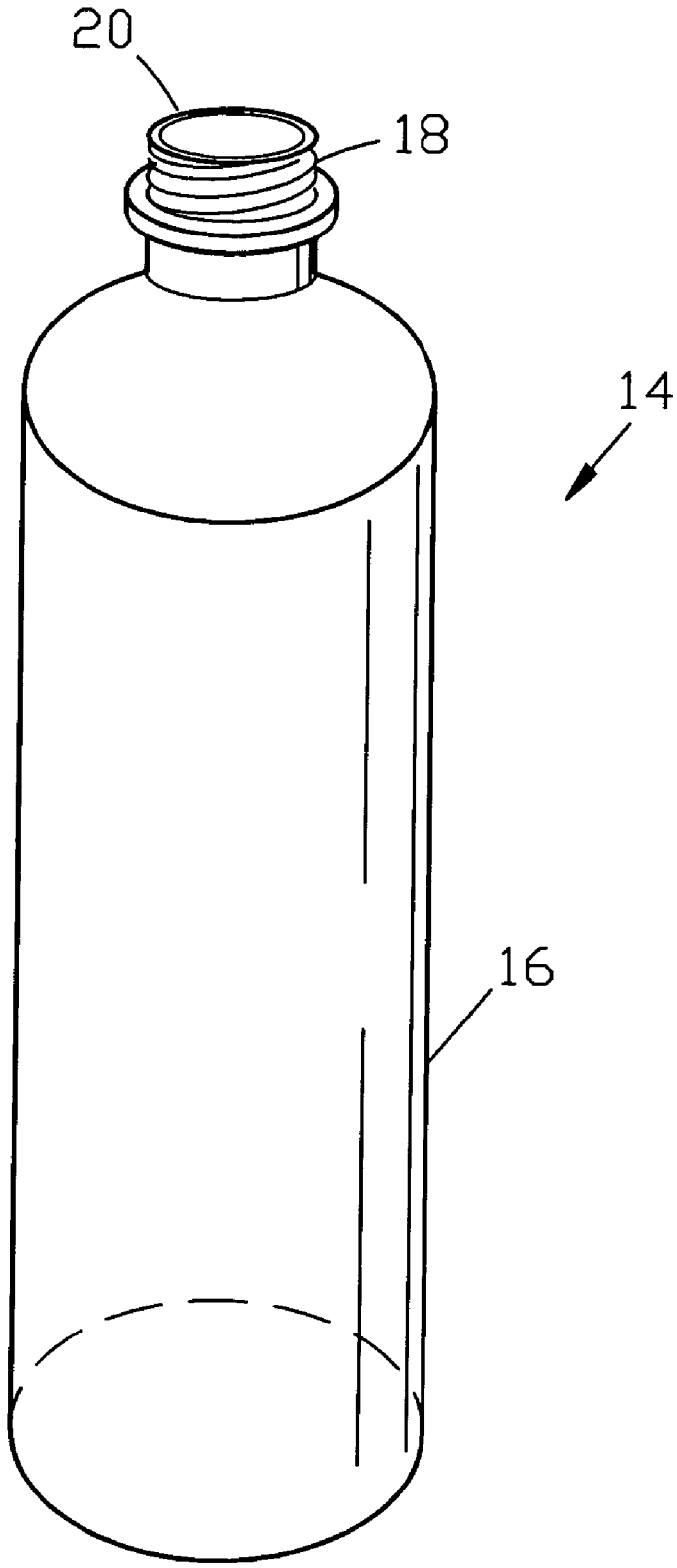
Fig. 1 PRIOR ART
FIG. 1 is a schematic perspective view of a prior art beverage bottle.

In operation, the second portion 34 of the cap 12 is stretched over a threaded portion (FIG. 1) of the mouth 18 of the beverage bottle 14 until the stop shelf 36 contacts or abuts the lip 20 on the mouth. The second portion 34 of the cap 12 clamping engages the mouth 18 of the beverage bottle 14. The stop shelf 36 helps to prevent the cap 12 from being stretched over the mouth 18 beyond the second portion 34 of the cap and into the first portion 24. The stop shelf 36 helps to seal the cap 12 over the mouth 18 of the bottle 14 to prevent the beverage from leaking out of the sides of the cap 12 (FIG. 2).

Figure 3:
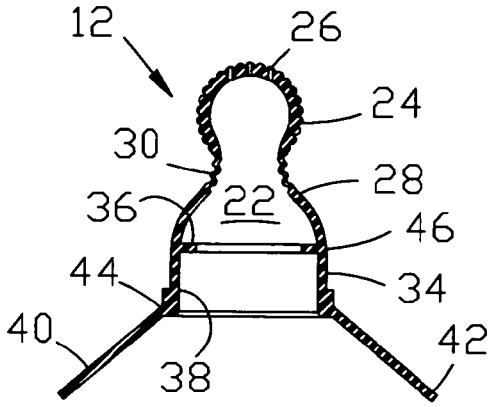
FIG. 3 is a sectional view taken along line 3—3 in FIG. 2 with parts removed.

The cap 12 includes two manually engageable pull tabs 40, 42 with rounded edges. The function of the pull tabs 40, 42 is to pull the second portion onto and off of the mouth of the beverage bottle 14 while the second portion 34 stretches. Alternatively, the cap 12 may have less than or more than two pull tabs in another embodiment (not shown). The pull tabs 40, 42 extend from the bottom edge 44 of the outer surface 46 of the second portion 34 in a downward diagonal direction when viewed in FIG. 3.

FIGS. 4–7 illustrate a second embodiment of the invention. The assembly 10*a* includes a cap 12*a*. The cap 12*a* is similar to the cap 12 shown in FIGS. 2–3, and parts that are the same or similar are given the same reference numerals with the suffix "a" attached. In this embodiment, the first portion 24*a* has a different construction from the first portion 24. The remainder of the cap 12*a* has an identical construction to the cap 12.

The cap 12*a* is a preformed, one piece unitary structure constructed from a soft elastic material such as rubber, latex or silicone. No portion of the cap 12*a* is hard or rigid. The cap 12*a* is washable and reusable. The cap 12*a* includes an axially extending passage 22*a* (FIG. 5) through which beverage in the bottle 14 may flow from the bottle. The first portion 26*a* of the cap 12*a* surrounds the passage 22*a* and is engageable with the lips of a child who consumes the beverage that flows through the passage 22*a* from the bottle 14.

Figure 4:
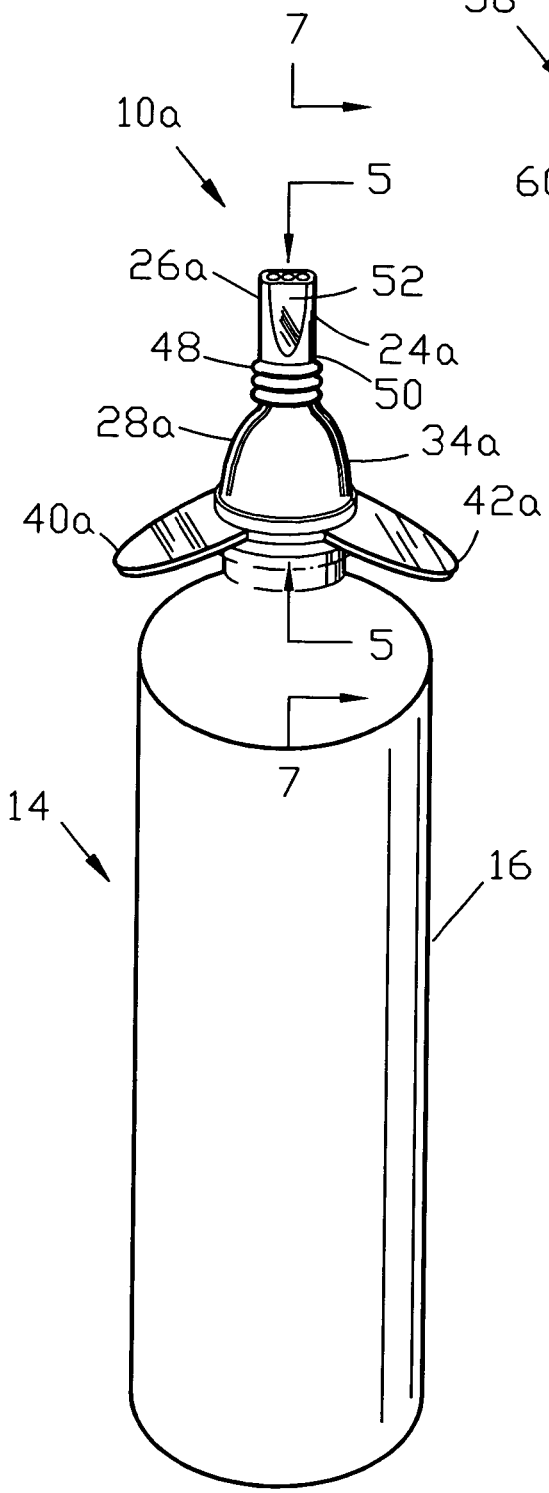
FIG. 4 is a schematic perspective view of the beverage bottle illustrated in FIG. 1 with a cap constructed in accordance with a second embodiment of the present invention.
Figure 6:
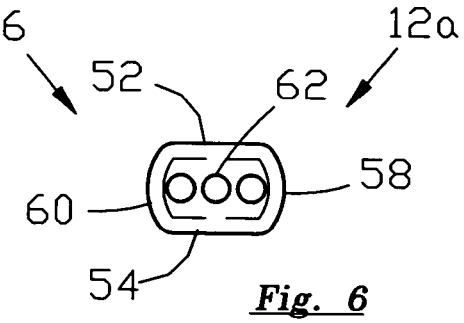
FIG. 6 is a plan view of the cap illustrated in FIG. 4 with parts removed.
Figure 5:
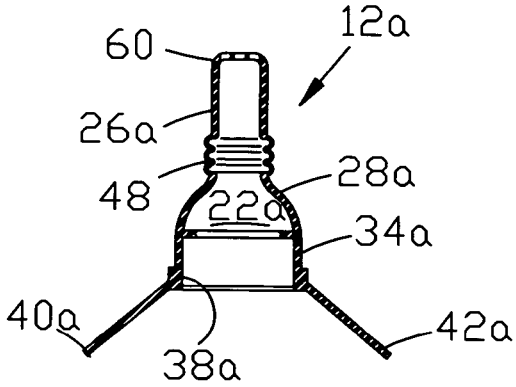
FIG. 5 is a sectional view taken along line 5—5 in FIG. 4 with parts removed.
Figure 7:
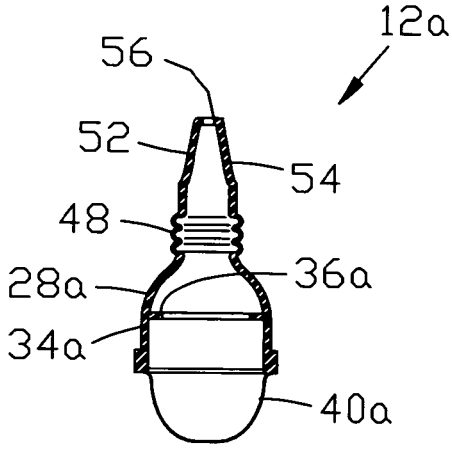
FIG. 7 is a sectional view taken along line 7—7 in FIG. 4 with parts removed.

The first portion 24*a* of the cap 12*a* has a oblong terminal end 26*a* (FIG. 5). The terminal end 26*a* has a base 50 and is circular in cross section at the base (FIG. 4). The terminal end 26*a* includes first and second tapering outer surfaces 52, 54 (FIG. 7). The tapering outer surfaces 52, 54 extend on opposite sides from each other from immediately adjacent the base 50 of the terminal end 26*a* to the tip 56 of the terminal end. The first and second tapering surfaces 52, 54 are separated by curved outer surfaces 58, 60 (FIG. 6). The cross section of the terminal end 26*a* is continuously reduced from the base of the terminal end to the tip 56 of the terminal end 26*a* (FIG. 7).

The tip 56 of the terminal end 26*a* of the cap 12*a* has an approximately oval shape when viewed in FIG. 6. The tip 56 of the terminal end 26*a* has an opening 62 larger than the opening (not shown) in the cap 12. The opening 62 comprises a row of three circular apertures when viewed in FIG. 6. The opening 62 in the cap 12*a* allows a larger amount of liquid to exit the cap 12*a* than the opening in the cap 12. The cap 12*a* is intended for use by children who can drink a larger amount of beverage.

Although three apertures are shown in the opening 62 of the cap 12*a*, the number of apertures may be less than or more than three in another embodiment. In addition, although the tip 56 of the terminal end 26*a* of the cap 12*a* has been described as having an approximately oval shape when viewed in FIG. 6, the tip may have any other shape including but not limited to circular, square, or rectangular.

The first portion 26*a* includes a bellows 48 region (FIG. 4). The bellows 48 is similar to the bellows in a drinking straw. The bellows 48 is movable between an extended position and a retracted position. The bellows 48 permits the terminal end 26*a* to be flexed or moved into an angled position relative to the frustum portion 28*a* and a second portion 34*a*.

The cap 12 includes a stretchable second portion 34*a* which clamping engages the beverage bottle 14 to hold the cap 12*a* on the bottle 14 (FIG. 4). The second portion 34*a* is circular in cross section and includes a stop shelf 36*a* (FIG. 7) on an inner surface 38*a* of the second portion. The stop shelf 36*a* is a protrusion extending around the entire circumference of the second portion 34*a* and extends perpendicularly away from the inner surface 38*a* of the second portion. At the location of the stop shelf 36*a*, the diameter of the second portion 34*a* is abruptly reduced. The stop shelf 36*a* is located immediately adjacent the frustum portion 28*a*.

In operation, as illustrated in FIG. 4, the second portion 34*a* of the cap 12*a* is stretched over the threaded portion of the mouth 18 of the beverage bottle 14 until the stop shelf 36*a* abuts or contacts the lip 20. The second portion 34*a* of the cap 12*a* clamping engages the mouth 18 of the beverage bottle 14. The stop shelf 36*a* helps to prevent the cap 12*a* from being stretched over the mouth 18 beyond the second portion 34*a* of the cap 12*a* into the first portion 24*a*. The stop shelf 36*a* helps to seal the cap 12*a* over the mouth 18 of the bottle 14 to prevent beverage from leaking out of the sides of the cap 12*a*.

The cap 12*a* includes two manually engageable pull tabs 40*a*, 42*a* with rounded edges (FIG. 4). The function of the pull tabs 40*a*, 42*a* is to pull the second portion 34*a* onto and off of the mouth 18 of the beverage bottle 14 while the second portion stretches. While only two pull tabs 40*a*, 42*a* are shown in FIG. 5, an alternative embodiment may include less than or more than two pull tabs. The pull tabs 40*a*, 42*a* extend from the bottom edge of the outer surface of the second portion 34*a* in a downward diagonal direction when viewed in FIG. 5.

The cap 12 and 12*a* advantageously adapts a conventional beverage bottle, such as a spring water bottle, regardless of specific brand name, for use by a infant/child. It should be understood that instead of a spring water bottle, the beverage bottle may be any other type of beverage suitable for infant/child consumption such as a juice bottle.

The cap 12, 12*a* eliminates the need for caregivers of children/infants to carry separate conventional sipper cups or conventional baby bottles in order to provide a beverage for the infant/child to consume. The cap 12 and 12*a* is convenient for caregivers of infants/children who purchase conventional bottled beverages while outside the home such as at an amusement park or shopping mall to adapt the bottled beverage for consumption by the infant/child.

From the above description of the invention, those skilled in the art will perceive improvements, changes and modifications. Such improvements, changes and modifications within the skill of the art are intended to be covered by the appended claims.

The invention claimed is:

1. A cap for a baby's beverage bottle, said cap comprising:

a passage through which beverage in the bottle may flow from the bottle, a first flexible elastic portion deformable by the baby's mouth and surrounding said passage and through which passage a baby can suck beverage, a second flexible elastic portion which clamping engages the beverage bottle to hold the cap on the bottle, said second portion stretching and then relaxing to clamping engage the beverage bottle and to hold said cap on said bottle, a pair of manually engageable pull tabs to pull said second portion onto said bottle and stretch said second portion, each of said pull tabs extending in a downward and outward direction with respect to said second portion, wherein each of said pull tabs has a length that is greater than the width of the first flexible elastic portion, which width is transverse to the direction of the flow of beverage through said passage, wherein said second portion has an outer surface, lip portion extending perpendicularly from said outer surface and circumferentially around said outer surface, said lip portion being attached to each of said pull tabs to reinforce said pull tabs, said entire cap being a pre-formed, one-piece unitary structure, wherein said second portion includes a circumferential inner surface and a stop member extending perpendicularly from said inner surface, said stop member abutting a lip of the beverage bottle when said second portion is stretched over said beverage bottle, wherein said first portion includes a terminal end with a tip including a plurality of apertures and a bellows located between said terminal end and a frustum portion, said terminal end includes first and second tapering outer surface extending on opposite sides from each other, said first and second tapering surfaces being separated by curved surfaces that said terminal end has an approximately oval cross section.

* * * * *